US009351895B2

(12) United States Patent
Ciblak et al.

(10) Patent No.: US 9,351,895 B2
(45) Date of Patent: May 31, 2016

(54) SPINAL SURGICAL TABLE

(71) Applicant: YEDITEPE UNIVERSITESI, Istanbul (TR)

(72) Inventors: Namik Ciblak, Istanbul (TR); Cem Tutcu, Istanbul (TR); Bilge Can Okumus, Istanbul (TR); Basar Atalay, Istanbul (TR)

(73) Assignee: YEDITEPE UNIVERSITESI, Istanbul (TR)

( * ) Notice: Subject to any disclaimer, the term of this patent is extended or adjusted under 35 U.S.C. 154(b) by 0 days.

(21) Appl. No.: 14/435,175

(22) PCT Filed: Oct. 11, 2013

(86) PCT No.: PCT/IB2013/002290

§ 371 (c)(1),
(2) Date: Apr. 13, 2015

(87) PCT Pub. No.: WO2014/057344

PCT Pub. Date: Apr. 17, 2014

(65) Prior Publication Data

US 2015/0265482 A1 Sep. 24, 2015

(30) Foreign Application Priority Data

Oct. 12, 2012 (TR) ..... 2012 11729

(51) Int. Cl.

| | |
|---|---|
| ***A61G 13/00*** | (2006.01) |
| ***A61G 13/02*** | (2006.01) |
| ***A61G 13/06*** | (2006.01) |
| ***A61G 13/10*** | (2006.01) |
| ***A61G 13/12*** | (2006.01) |

(52) U.S. Cl.

CPC ..... *A61G 13/0036* (2013.01); *A61G 13/02* (2013.01); *A61G 13/06* (2013.01); *A61G 13/10* (2013.01); *A61G 13/121* (2013.01); *A61G 13/122* (2013.01); *A61G 13/123* (2013.01); *A61G 13/128* (2013.01); *A61G 2013/0054* (2013.01); *A61G 2200/325* (2013.01)

(58) Field of Classification Search

CPC ..... A61G 13/00
USPC ..... 5/621–624, 81.1 R, 601, 613
See application file for complete search history.

(56) References Cited

U.S. PATENT DOCUMENTS

| | | | | |
|---|---|---|---|---|
| 4,583,725 | A | 4/1986 | Arnold | |
| 6,154,901 | A | 12/2000 | Carr | |
| 2006/0242765 | A1 * | 11/2006 | Skripps | A61G 13/04 5/621 |
| 2006/0248650 | A1 * | 11/2006 | Skripps | A61G 13/04 5/621 |

FOREIGN PATENT DOCUMENTS

| | | | |
|---|---|---|---|
| CA | 2298088 | | 8/2001 |
| FR | 2814941 | A1 | 4/2002 |
| WO | WO2005/034827 | A | 4/2005 |
| WO | WO2010040120 | | 4/2010 |

* cited by examiner

*Primary Examiner* — Fredrick Conley
(74) *Attorney, Agent, or Firm* — Gokalp Bayramoglu

(57) ABSTRACT

The present invention relates to a spinal surgical table which is used during spine and spinal-related surgical operations and on which the patient is laid down. The spinal surgical table includes at least one carrying skeleton, at least one carrying connection member, at least one stand, at least six supporting pads, and at least one head rest. The present invention enables to decrease pressure-related complications by leaving the abdominal area on the hole, be connected to any kind of operation table, be accorded with different body sizes and be accorded with the position of the patient. The present invention can also be connected to other apparatuses which help position the patient.

12 Claims, 4 Drawing Sheets

SPINAL SURGICAL TABLE

FIELD OF THE INVENTION

The present invention relates to a spinal surgical table which is used during spine and spinal-related surgical operations and on which the patient is laid down.

BACKGROUND OF THE INVENTION

As the spine is at the back of the body, prone, which is the face-down position, is used very often in spine surgery. There is an increase in pressure at the abdominal area in patients who stay in this position, and this pressure causes increase in bleeding in the operation region. This situation creates difficulty in working during the operation and extends the time of the operation. Moreover, some contusions occur at the patients who stay for long hours at the same position and this causes to extend the recovery period.

Current studies show that positioning the abdominal area of the patient such that it will remain at hole during the operation plays an important role in decreasing complications related to pressure.

Today, these operations are generally performed by the cushions put at the sides of the patient or with specially prepared supports; however this situation cannot provide a complete solution to position the patient right and to enable the safety of the operation. A few operation tables produced for this purpose are not preferred by hospitals due to high costs. Also, some models operators have difficulty in some conditions as they are not produced from a material which is permeable for x-ray that is necessary during the operation.

The international patent document no. WO2010040120, an application in the state of the art, discloses a prone surgery facial support device to be used during operations performed in prone position. The device provides high safety and creates an open and accessible environment for the anesthesiologist.

The Canadian patent document no. CA2298088, another application in the state of the art, discloses a frame for prone surgical positioning which is a frame placed on a conventional operating table and used in operation performed in a prone position. The frame has two longitudinal beams and two lateral beams. There are six vertical posts and six supporting pads on these posts. One pair of the pads are positioned under the patient's body to support the patient's upper chest, a second pair to support the antero-lateral aspects of the thorax, and the third pair to support the pelvis.

SUMMARY OF THE INVENTION

The objective of the invention is to provide a spinal operation table which enables to decrease pressure-related complications by leaving the abdominal area on the hole.

Another objective of the invention is to provide a spinal surgical table designed to be connected to any kind of operation table.

Another objective of the invention is to provide a spinal surgical table designed to be accorded with different body sizes.

Another objective of the invention is to provide a spinal surgical table which is produced from a material that is transparent for radio and x-rays and thus enables to apply the procedures by these rays during the operation.

Another objective of the invention is to provide a spinal surgical table which includes pads that can be accorded with the position of the patient, by moving in 3 different axes.

Another objective of the invention is to provide a spinal surgical table to which the other apparatuses (arm rest, head rest etc.) that help position the patient can be connected.

DETAILED DESCRIPTION OF THE INVENTION

A spinal surgical table developed to fulfill the objectives of the present invention is illustrated in the accompanying figures, in which.

Figure 1:
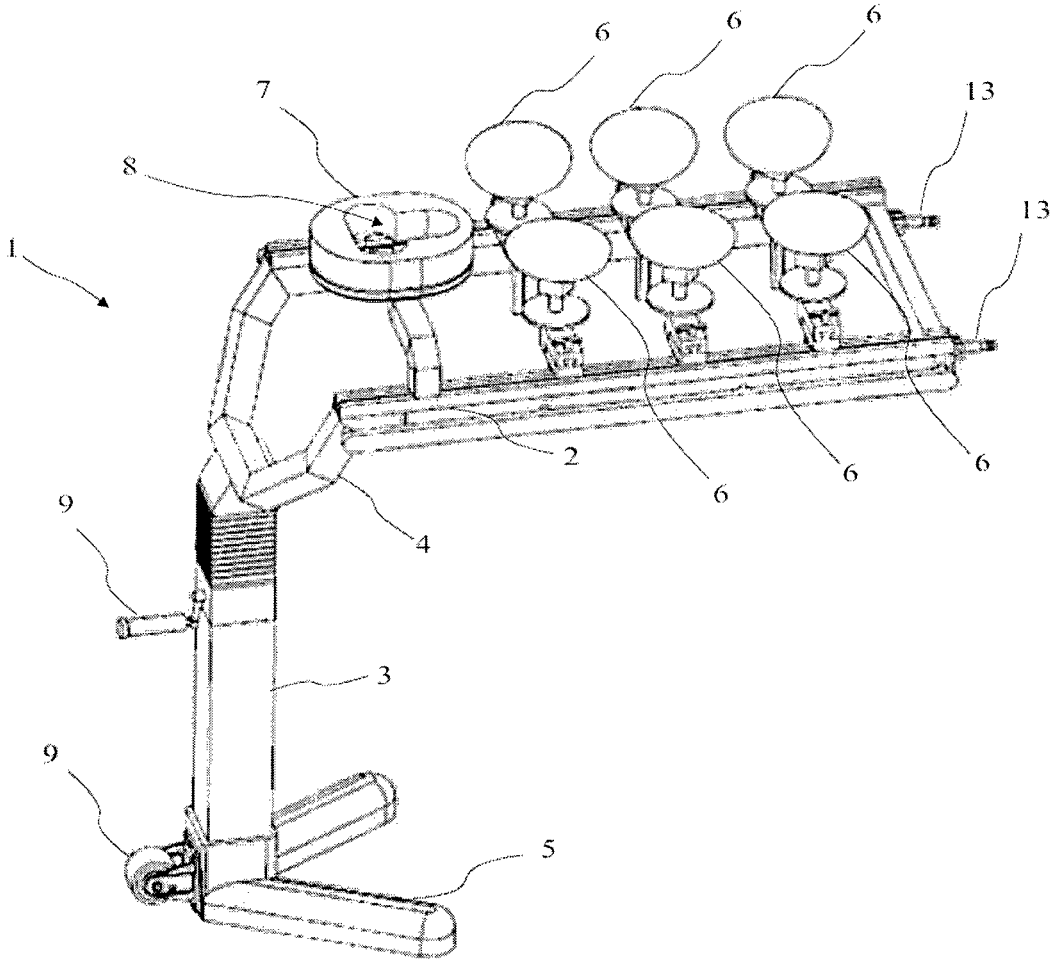
FIG. 1 is the perspective view of the inventive spinal surgical table.
Figure 2:
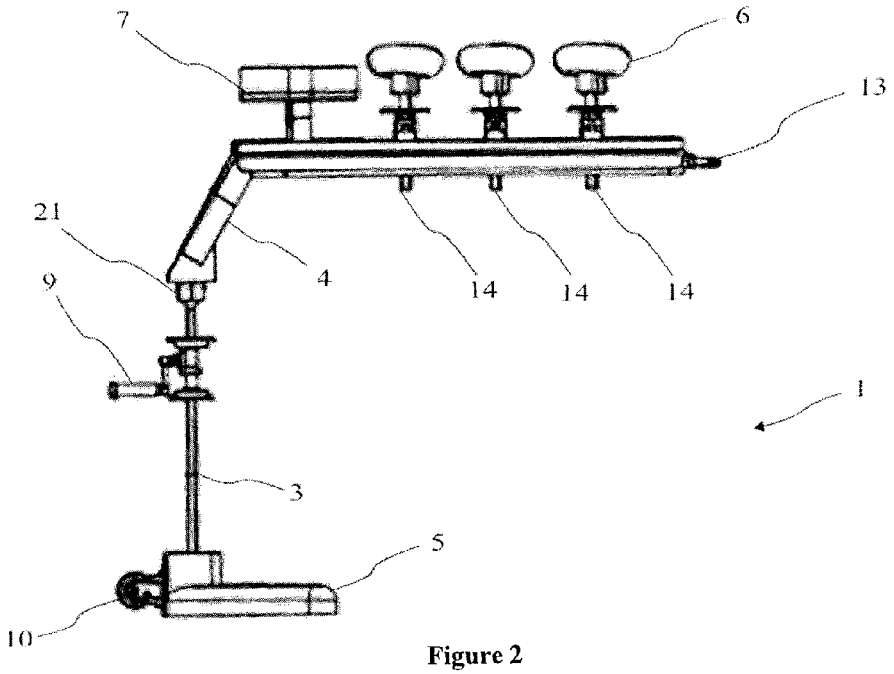
FIG. 2 is the side view of the inventive spinal surgical table.
Figure 3:
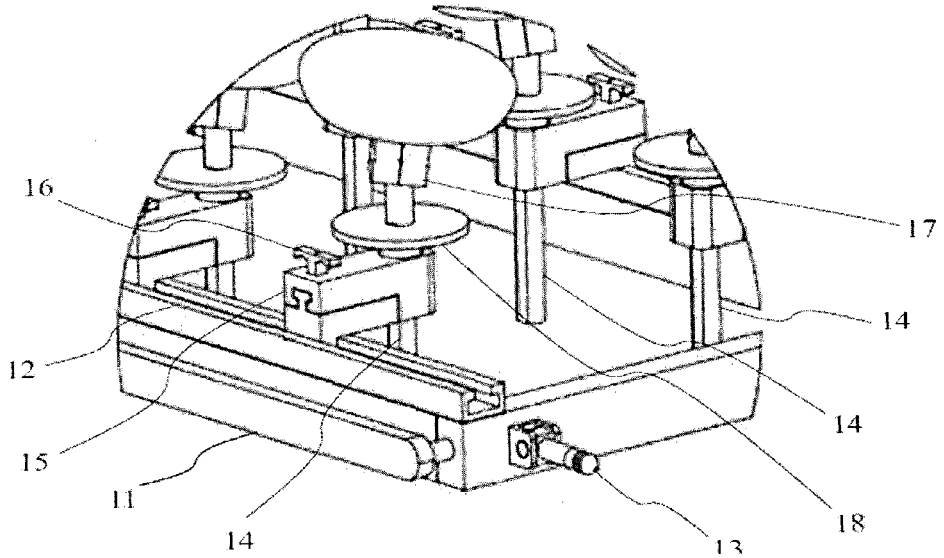
FIG. 3 is the perspective view of one pad that is placed on the inventive spinal surgical table and its connection with the skeleton.
Figure 4:
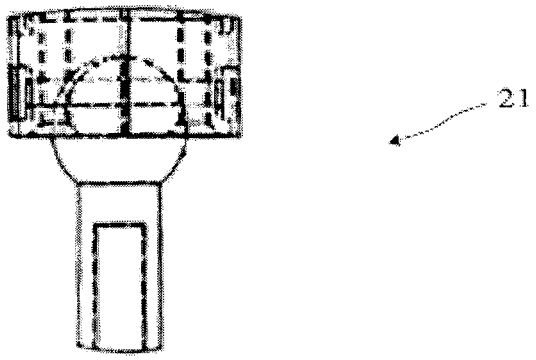
FIG. 4 is the frontal view of the spherical skeleton connection member.
Figure 5:
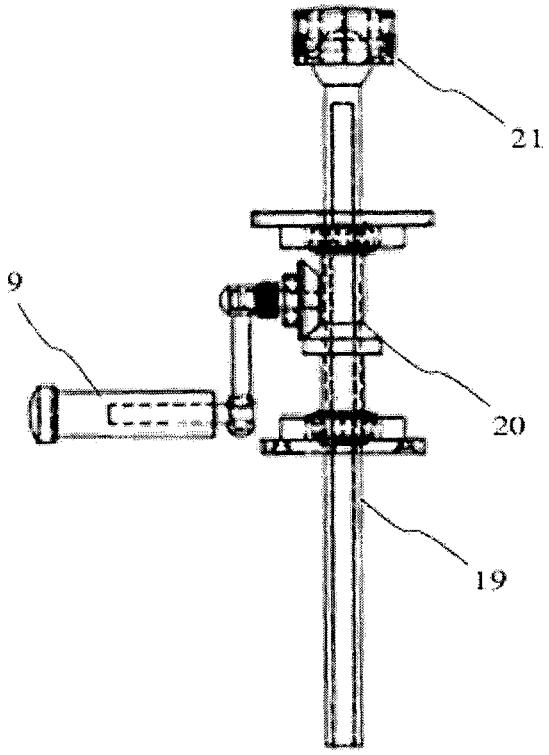
FIG. 5 is the frontal view of the mechanism in the carrier handle.
Figure 6:
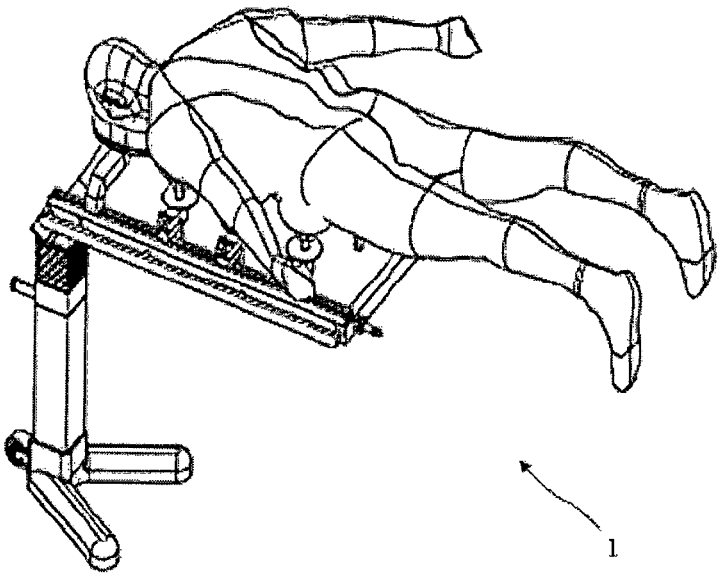
FIG. 6 is the perspective view of the inventive spinal surgical table when the patient is lying thereon.
Figure 7:
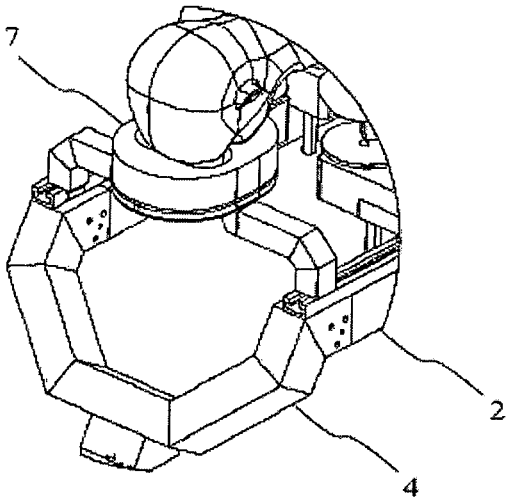
FIG. 7 is the magnified front perspective view of the inventive spinal surgical table.

The components in the figures are assigned reference numerals as follows:

1. Spinal Surgical Table
2. Carrying skeleton
3. Carrying column
4. Carrying connection member
5. Stand
6. Supporting pad
7. Head rest
8. Hole
9. Adjustment arm
10. Wheel
11. Additional connection rod
12. Lateral rail system
13. Connection adapter
14. Pad power screw
15. Vertical rail system
16. Pad adjustment pin
17. Spherical pad connection member
18. Adjustment disk
19. Skeleton power screw
20. Gear
21. Spherical skeleton connection member The inventive spinal surgical table (1) essentially comprises

- at least one carrying skeleton (2) which carries the weight of the patient's body,
- at least one carrying column (3) which is connected with the carrying skeleton (2),
- at least one carrying connection member (3) which connects the carrying skeleton (2) to the carrying column (3),
- at least one stand (3) which is connected to the carrying skeleton (2) by means of the carrying column (3) and enables the carrying skeleton (2) to stand in balance,
- at least four and an increasable number of supporting pads (6) which is placed on the carrying skeleton (2) and enables the body comfort while the patient is lying,
- at least one head rest (7) which is placed at the front edge of the carrying skeleton (2) and enables the patient to lie his/her head comfortably,
- at least one hole (8) which is at the middle of the head rest (7), at least one adjustment arm (9) which is placed on the carrying column (3) and by which the height of the carrying skeleton (2) is adjusted, at least one wheel (10) which is fixed to the stand (5), at least two additional connection rods (11) which lie at two sides of the carrying skeleton (2) and enable to attach the external apparatuses to the table (1), at least two lateral rail systems (12) which enable the supporting pads (6) to move back and forth on the skeleton (2) in a linear way, at least connection adapter (13) which enables the table (1) to extend at the rear edge of the skeleton (2) by being connected to other operation tables, at least six pad power screws (14) which connect the supporting pads (6) to the carrying structure (3), at least six vertical rail systems (15) which enable the supporting pads (6) to move towards right-left on the carrying skeleton (2) in a linear way, at least six pad adjustment pins (16) which enable the supporting pads (6) to be fixed by being locked at the position they take with right-left movements, at least six spherical pad connection members (17) which enable the connection of the supporting pads (6) with the pad power screws (13), at least six adjustment disks (18) which enable the supporting pads (6) to move up and down on the carrying skeleton (2), at least one skeleton power screw (19) which lies within the carrying column (3), at least one gear (20) which is placed on the skeleton power screw (19), and enables the table (1) to move up-down by rotating in the axis vertical to the adjustment arm (9) with the rotation of the adjustment art (9), at least one spherical skeleton connection members (21) which is at the point where the skeleton power screw (19) connects with the carrying skeleton (2).

The carrying skeleton (2) can be connected to the current operation tables by means of one or more connection adapters (13) at the rear edge thereof, thus can be used for multipurpose being adapted to different body sizes. In the preferred embodiment of the invention, there are two connection adapters (13).

The carrying column (3) connects the carrier (2) and the stand (5) to each other and enables the coordination between them.

The carrying connection member (4) is in the form of an inter-connection that enables the anesthetist to reach the face and mouth area of the patient comfortably by means of its U-like structure. In the preferred embodiment of the invention, two edges of the carrying connection member (4) are connected to the skeleton (2) and the curved part is connected to the carrying column (3).

The stand (5) enables the carrying skeleton (2) to move, be rotated and carried from one place to another easily, by means of one or more wheels (10) that are fixed thereon and are in contact with each other.

The supporting pads (6) are the supporting members that leave the abdominal area on the hole in the prone position, supporting the patient from at least six different points, and have the ability to move in three different axes (back-forth, right-left, up-down) independently from each other. The supporting pads (6), are not only used for positioning but also enable the vertebras to be separated from each other by giving spinal curvature to the patient being raised and lowered, and allow the surgeon to work easily between the vertebras. The said pads (6) can be used in different configurations for every patient and be fixed in the most suitable position for the operation by means of that feature. In the preferred embodiment of the invention, there are six supporting pads in total; 2 supporting for chest, abdominal and pelvis each.

The head rest (7) has a hole (8) which enables the eye and mouth parts of the patient to be at clearance and allows the passage of the pipes and cables necessary for anesthesia, in prone lying positions.

The adjustment arm (9) operates in coordination with the gear (20), enables the up-down movement of the carrying skeleton (2) by rotating; and allows the upper part of the patient (upper waist) to be in an angular position according to the lower part (lower waist) of the patient, and lets the patient to be operated.

The additional connection rod (11) is in the form of a protrusion which enables to fit apparatuses such as the arm rest that are desired to be added to the table (1).

The lateral rail system (12) is in the form of a path which lies at the two sides of the carrying skeleton (2) and enables the supporting pads (6) to be moved in parallel with the carrying skeleton (2) in order to make an adjustment according to the body length of the patient.

The pad power screw (14) is in the form of a rod which is attached under the pad (6) by means of the spherical pad connection member (17) and enables the connection of each supporting pad (6) with the carrying skeleton (2).

The vertical rail system (15) is in the form of a sliding block which transact vertically with the lateral rail system (12) in the same plane, and enables to move the pads in order to make an adjustment according to the body width of the patient.

The pad adjustment pin (16) is in the form of a key which allows the movement of the supporting pads (6) on the vertical rail system (15) by being locked and unlocked or fixes the supporting pads (6) on the vertical rail system (15) in the preferred position.

The spherical pad connection members (17) enable wide movement ability for the supporting pads by means of their joint-like structure and thus enable the supporting pads (6) to take position according to the patient's body shape.

The pad adjustment disk (18) is in the shape of a circle with a hole in the middle, which is placed on the pad power screw (14) and enables to adjust the height of the supporting pads (6) by rotating on this screw (14).

The skeleton power screw (19) is in the form of a rod which is connected to the front edge of the carrying skeleton (2) by means of the spherical skeleton connection member (17) and enables the connection of the carrying skeleton (2) with the stand (5); and adjusts the height of the carrying skeleton (2) by extending and shortening when necessary.

The spherical skeleton connection member (21) enables to raise and lower one edge of the carrying skeleton (2) by means of its joint-like structure, and thus to make operation on the patient in different angles.

The inventive spinal surgical table (1) leaves the abdominal area of the patient at clearance by the help of the supporting pads that have high movement ability (linear movement in 3 different axes, and articular movement) included therein, and also enables high comfort by supporting the patient's body from many points. It can be connected to every kind of current operation tables by means of the connection adapters (13) and has the feature to be adjustable according to the patient's body length.

Also; as all of the members on the inventive spinal surgical table can pass radio and X-rays, it can be used in the operations in which these rays are used.

By means of the additional connection rods (11) at both sides of the table (1), the members (arm rest etc.) that are not included in the spinal surgical table (1) and are desired to be added can be jointed to the table (1) later.

Within the scope of these basic concepts, it is possible to develop various embodiments of the inventive spinal surgical table (1). The invention can not be limited to the examples described herein; it is essentially as defined in the claims.

The invention claimed is:

1. A spinal surgical table comprising:

at least one carrying skeleton configured to carry the weight of a patient's body;

at least one carrying column connected with the carrying skeleton at least one carrying connection member which connects the carrying skeleton to the carrying column, wherein the carrying connection member comprises two arms, each of the two arms is connected to the carrying skeleton;

at least one stand connected to the carrying skeleton through the at least one carrying column;

a plurality of supporting pads which are placed on the carrying skeleton;

at least one head rest which is placed at the front edge of the carrying skeleton;

at least one hole which is located at the middle of the head rest;

at least one adjustment arm which is set on the carrying column and configured to adjust the height of the carrying skeleton;

at least one wheel which is fixed to the stand;

at least two additional connection rods located at two sides of the carrying skeleton and configured to attach a plurality of external apparatuses to the table;

at least two lateral rail systems configured to move the plurality of supporting pads back and forth on the carrying skeleton in a linear way;

at least one connection adaptor configured to connect the table at a rear edge of the skeleton to other operation tables;

a plurality of screws configured to support the supporting pads and move the supporting pads up and down;

a plurality of vertical rail systems configured to fix the pad power screws and move the pad power screws in the right or left direction on the carrying skeleton in a linear way;

a plurality of pad adjustment pins configured to lock the vertical rail systems in a position based on the movements made in the right or left direction;

a plurality of spherical pad connection members located on the top ends of the pad power screws, wherein each of the plurality of spherical pad connection members comprises a first joint-like structure which is configured to connect the supporting pads to the pad power screws, and adjust the supporting pads in different angles;

a plurality of adjustment disks set on the pad power screw and configured to adjust the supporting pads up and down on the vertical rail systems by rotating the adjustment disks;

at least one skeleton power screw set within the carrying column;

at least one gear which is set on the skeleton power screw, and configured to adjust a height of the table by rotating the adjustment arm in an axis vertical to the adjustment arm;

at least one spherical skeleton connection member set on a top end of the skeleton power screw, wherein the at least one spherical skeleton connection member is configured to connect the skeleton power screw to the carrying skeleton, and to raise and lower one edge of the carrying skeleton via a second joint-like structure, thus enabling operation on the patient from many different angles.

2. The spinal surgical table according to claim 1, wherein the supporting pads are configured to leave an abdominal area of the patient on the hole in a prone position, support the patient from at least six different points, move in three different axes, namely back and forth, right and left, and up and down, independently from each other, enable the vertebras to be separated from each other by giving spinal curvature to the patient being raised and lowered.

3. The spinal surgical table according to claim 1, wherein the carrying skeleton is connected to the other operation tables through the at least one connection adaptor.

4. The spinal surgical table according, to claim 1, wherein the carrying column is configured to connect the carrying skeleton to the stand and coordinate the connection of the carrying skeleton and the stand.

5. The spinal surgical table according to claim 1, wherein the carrying connection member enables an anesthetist to reach the face and mouth area of the patient comfortably through a U-like structure.

6. The spinal surgical table according to claim 1, wherein the stand enables the carrying skeleton to move, be rotated and carried from one place to another easily through at least one wheel that is fixed thereon and in contact with each other.

7. The spinal surgical table according to claim 1, wherein the head rest is set with a hole that enables the eye and mouth parts of the patient to be at clearance and allows a passage of the pipes and cables necessary for anesthesia.

8. The spinal surgical table according to claim 1, wherein one end of the adjustment arm engages with the gear, the adjustment arm is configured to move the carrying skeleton up and down by rotating, allow the upper waist of the patient to be in an angular position according to the lower waist of the patient, and allow the patient to be operated in different angles.

9. The spinal surgical table according to claim 1, wherein the lateral rail system lies at two sides of the carrying skeleton and is configured to move the supporting pads in parallel with the carrying skeleton in order to make an adjustment according to the body length of the patient.

10. The spinal surgical table according to claim 1, wherein the skeleton power screw is connected to the front edge of the carrying skeleton through the spherical skeleton connection member and connects the carrying skeleton to the stand, and adjusts the height of the carrying skeleton by extending and shortening.

11. The spinal surgical table according to claim 1, wherein the vertical rail systems move vertically with the lateral rail system in a same plane to make an adjustment according to the body width of the patient.

12. The spinal surgical table according to claim 1, wherein the pad adjustment pins are configured to lock and unlock the supporting pads on the vertical rail system in a preferred position.

* * * * *